United States Patent [19]

Moji et al.

[11] 3,989,876

[45] Nov. 2, 1976

[54] METHOD OF ANODIZING TITANIUM TO PROMOTE ADHESION

[75] Inventors: Yukimori Moji, Bainbridge Island; J. Arthur Marceau, Seattle, both of Wash.

[73] Assignee: The Boeing Company, Seattle, Wash.

[22] Filed: May 27, 1975

[21] Appl. No.: 581,208

Related U.S. Application Data

[62] Division of Ser. No. 424,792, Dec. 14, 1973, Pat. No. 3,959,091.

[52] U.S. Cl. ..... 428/472; 148/31.5; 204/38 A; 204/42; 204/56 R

[51] Int. Cl.[2] ..... C25D 5/00; B32B 15/04

[58] Field of Search ..... 428/472; 148/31.5; 204/38 A, 42, 56 R

[56] References Cited

UNITED STATES PATENTS

| | | | |
|---|---|---|---|
| 3,025,225 | 3/1962 | Snyder et al. | 204/145 |
| 3,180,807 | 4/1965 | Quinn | 204/38 A |
| 3,502,552 | 3/1970 | Mizushima et al. | 204/56 R |
| 3,714,001 | 1/1973 | Dorsey | 204/38 A |
| 3,799,848 | 3/1974 | Kolic et al. | 204/38 A |
| 3,840,442 | 10/1974 | Chevalier et al. | 204/38 A |

OTHER PUBLICATIONS

NASA Technical Memorandum, Aug. 4, 1965, "Adhesive Bonding of Titanium etc.," Keith et al., NASA TMX-53313, pp. 18–34.

*Primary Examiner*—Harold Ansher
*Attorney, Agent, or Firm*—Christensen, O'Connor, Garrison & Havelka

[57] ABSTRACT

Porous, adhesion-promoting oxide coatings are formed on titanium by anodizing in an aqueous solution containing fluoride ion and one or more oxidizing electrolytes at current densities of from 0.25 to 5 amp./ft.$^2$.

33 Claims, 2 Drawing Figures

METHOD OF ANODIZING TITANIUM TO PROMOTE ADHESION

This is a divisional of application Ser. No. 424,792, filed 12/14/73, now U.S. Pat. No. 3,959,091.

BACKGROUND OF THE INVENTION

This invention relates to a surface treatment process for titanium, and in a particular aspect, to a process for treating the surface of titanium structural members preparatory to the application thereto of adhesives, sealants, organic coatings and the like.

With the accelerating usage of titanium alloys for aircraft structures, the problems of promoting adhesion of coatings (e.g., sealants, adhesives and paints) to this metal have become increasingly apparent. In general, adhesion of organic materials to titanium has been rather poor. Adhesion can be improved by surface treatment techniques in which anodic or chemical films are deposited on the titanium. During the past decade, a host of titanium surface treatments have been reported, most of which have been developed for prevention of galling and fretting. The "Pasa-Jell" conversion coating process (developed by Semco Sales and Service Co., Los Angeles, Calif.) and the phosphate-fluoride conversion coating process (U.S. Pat. No. 2,864,732) have been widely used for surface treatment prior to adhesive bonding of titanium and titanium-containing alloys. When titanium adherends surface treated by either of these methods are subjected to adhesive bonding, initial bond strengths are usually acceptable. However, when the bonds are exposed to high humidity environments, the quality of the bonds is seriously deteriorated. As a consequence, numerous bond-joint failures in titanium adhesive sandwich structures have been experienced in commercial aircraft. Most of the titanium adherends in these structures were treated by the phosphate-fluoride process prior to adhesive bonding. Service failure analyses have shown that the failures invariably occur at the adhesive-metal interface while the cured adhesive remains generally unchanged and exhibiits good cohesive bonding. Hence, it appears that in service environments, the adhesive-metal interface is the weakest point in adhesively bonded structures.

It is therefore an object of this invention to overcome or mitigate the foregoing and other shortcomings of the prior art by providing a process for producing on titanium and titanium alloys coatings that are uniform and strong and will form environmentally stable bonds to adhesives and other coatings. It is another object of this invention to provide titanium structural members having prepared surfaces that will exhibit superior adhesive bonding and adherence to sealants and coatings. A further object is to provide adhesively bonded titanium composites exhibiting excellent structural integrity in high humidity environments. Other objects and advantages of this invention will be apparent from the following.

SUMMARY OF THE INVENTION

In summary, this invention is directed to a method of forming a porous, adhesion promoting, oxide coating on a titanium article comprising anodizing the article in an aqueous solution comprising fluoride ions and an oxidizing electrolyte, the pH of said solution being less than 6 (preferably less than 3), the anodizing potential being from 5 to 40 volts (preferably from 7.5 to 20 volts, and more preferably from 10 to 15 volts) and the fluoride ion concentration being such as to result in a current density of from 0.25 to 5 (preferably 0.5 to 4 and more preferably 1 to 3) amperes per square foot.

This invention is also directed to titanium articles anodized by the process of this invention, to such titanium articles having an organic coating (e.g., an adhesive, paint or sealant) adhered to the oxide coating thereon, and to adhesively bonded composites produced by adhesively bonding together anodized titanium elements of this invention.

DETAILED DESCRIPTION OF THE INVENTION

The process of this invention has been shown to produce titanium oxide coatings which, when incorporated into adhesively bonded systems, provide environmentally stable bonds superior to those obtainable with otherwise identical systems in which the titanium coating was produced by the Pasa-Jell or phosphate-fluoride process. The improved environmental stability has been consistently demonstrated in all tests, regardless of the precise anodizing solution or conditions utilized. Tests have also shown that the adhesion of paint to oxide-coated titanium specimens of this invention is significantly better than adhesion of paint to specimens treated by the Pasa-Jell and phosphate-fluoride processes. Exemplary of the wide variety of organic and inorganic coatings that can be applied to the anodized titanium articles of this invention are adhesives based on epoxys, nitrile phenolics, polyquinoxalines, poly-astriazines, polyamides, polyimides, polyesters and blends thereof; epoxy and urethane based paints; and polysulfide and silicone sealants.

Figure 1:
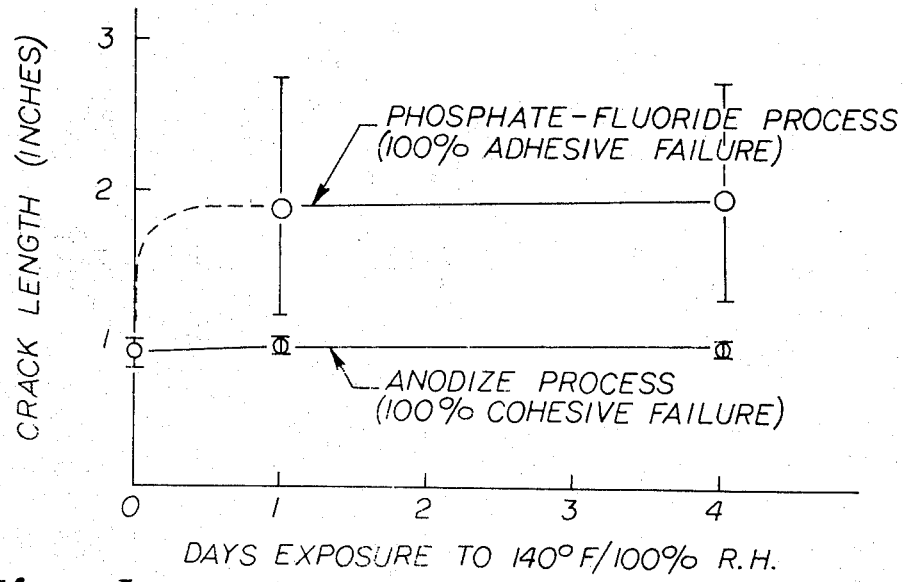
FIG. 1 contrasts the growth rates of cracks in adhesively bonded specimens in which the surfaces of the adherends were pretreated by the prior art phosphate-fluoride process and by the anodizing process of this invention.
Figure 2:
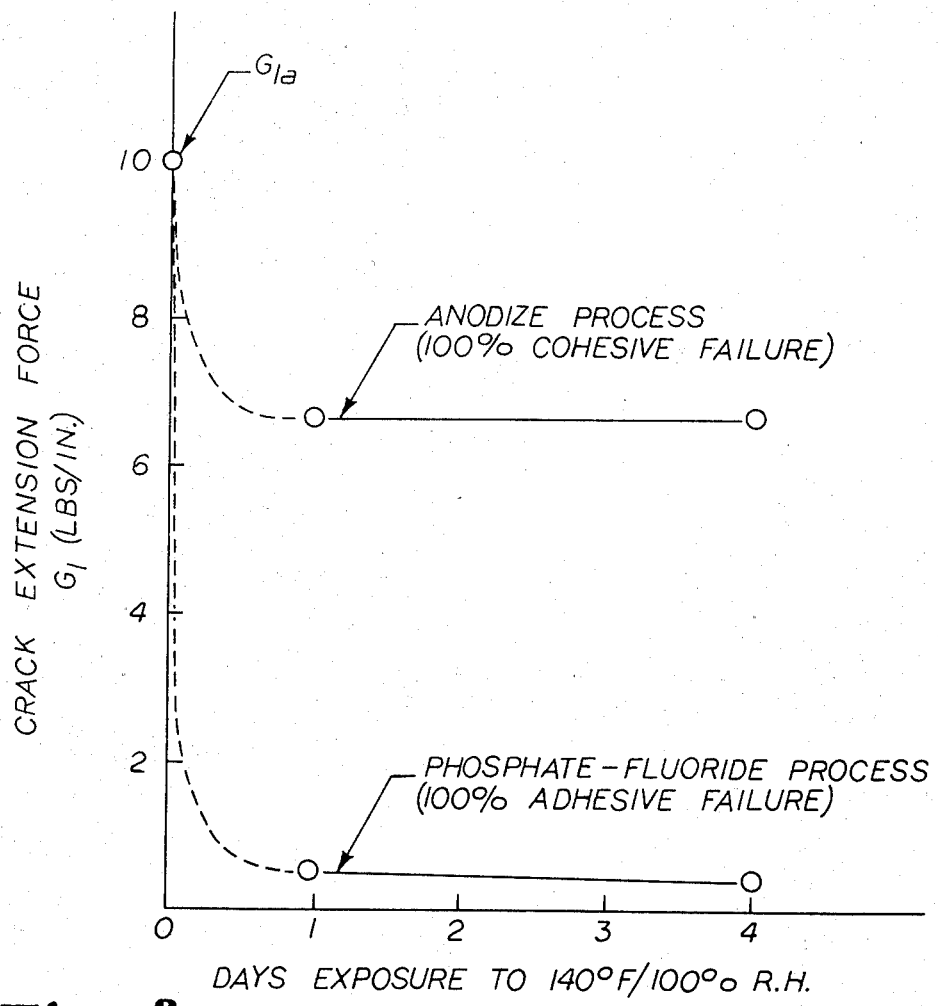
FIG. 2 contrasts the forces at the crack tip required to effect the crack growths shown in FIG. 1.

A comparison of the adhesion-promoting characteristics of coatings produced by the process of this invention and coatings produced by phosphate-fluoride process is provided in FIGS. 1 and 2. FIG. 1 contrasts the average crack growth rates which resulted when adhesively bonded assemblies prepared from titanium panels pretreated by the phosphate-fluoride process and the process of this invention were exposed to 140° F./100% relative humidity environments. The vertical bars represent the spread in the data and each point is the average. The data spread was far more for the assemblies prepared from titanium panels subjected to the phosphate-fluoride process. Also, the failure mode was always 100% adhesive, whereas bonded assemblies prepared from titanium panels subjected to the preferred anodizing process of this invention exhibited failure modes which were 100% cohesive.

FIG. 2 shows the crack extension force, $G_1$, (force at the crack tip) versus exposure time in a 140° F./100% relative humidity environment for the crack growths shown in FIG. 1. $G_1$ values were calculated according to Journal of Materials, Vol. 2, No. 3 (1967). The anodizing conditions employed to prepare panels which were subsequently formed into bonded assemblies and tested to obtain the data shown in FIGS. 1 and 2 were as follows: the panels were anodized for 20 minutes in a 5% chromic acid plus hydrofluoric acid solution at potentials of 10 and 15 volts and current densities of from 1 to 3 amperes per square foot (hereafter abbreviated "asf."); the solution temperature was 70°–75° F.

Compared to the Pasa-Jell and phosphate-fluoride processes, the process of this invention gives more consistent results, is less expensive to practice and is more easily controlled. The amount of active (ionized) fluoride in the baths used in the phosphate-fluoride process is very difficult to control due to formation of $K_2TiF_6$. This typically results in the formation of non-uniform coating. The consistency of the results showing marked improvements in bond stability over a fairly wide range of anodizing conditions indicates that the process of this invention is quite forgiving. Low voltage and current densities mean low wattage and therefore lower operating costs than other anodizing processes, yet the potential is high enough and the current density stable enough to maintain a positive control of oxide formation. Current density control (one of the keys to the process) is quite simple and requires only the addition of enough ionizable fluoride ions to the solution to maintain a consistent current density and oxide dissolution rate.

Scanning Electron Micrographs have shown the oxide coatings formed by the process of this invention to be highly porous. The working hypothesis is that the pores are columnar in nature, normal to the metal surface and open at the oxide surface, and that the pores are formed by localized fluoride attack on the oxide as it is formed during anodization. It is assumed that the competing deposition and dissolution reactions reach a dynamic equilibrium after which the gross thickness of the oxide coating does not increase. The improved adhesion-promoting characteristics of the coatings of this invention are attributed to their high porosity and surface area. Also, it is thought that the oxide dissolution reaction results in the oxide surface having greater activity toward coatings that are polar in character.

Characterization of the titanium oxide coatings produced by the methods of this invention have shown the coatings to be much thicker than conversion coatings produced by the Pasa-Jell and phosphate-fluoride processes. Generally, the coatings will be at least 500 A thick, the particular thickness being dependent on the anodizing potential, current density, time and temperature; and the concentrations of fluoride and hydrogen ions. When a potential of 15 volts was employed in one experiment, the oxide produced was about 2,500 A thick whereas oxides formed at 10 and 5 volt potentials had approximate thicknesses of 2,000 A and 1,000 A respectively.

Titanium oxide coatings produced by the process of this invention are more brittle than the base metal as illustrated by Scanning Electron Micrographs showing that plastic deformation of the titanium base metal causes the titanium oxide coating to fracture. However, the bulk properties of the oxide coating are generally strong enough to withstand stresses imparted on the bond lines while being subjected to mode I (cleavage) and mode II (shear) fracture. An exception to this is an apparent embrittlement which sometimes occurs at the oxide-metal interface when the titanium specimens have been acid etched prior to being anodized. This embrittlement is attributed to hydrogen ion absorption during preanodization acid etching. The embrittlement at the oxide-metal interface is not a problem of bulk oxide embrittlement per se, but rather is an embrittlement of either the oxide-metal transition zone or the very outer layers of the metal near the transition zone. Although many specimens have been examined by S.E.M.; no intraoxide failure has been noted. The embrittlement is greatly influenced by the anodizing voltage, the degree of brittleness increasing with the increasing applied voltage. The oxide-metal interfacial embrittlement problem associated with the use of the acid etch can be avoided by using chemical or mechanical cleaning processes that do not produce nascent hydrogen, e.g., alkaline etching or sand blasting.

The source of fluoride ions used in the anodizing solutions can be any salt or acid that is sufficiently soluble in water to provide the necessary fluoride ion concentration, e.g., hydrofluoric acid, ammonium fluoride, ammonium bifluoride, and sodium and potassium fluorides. The presently preferred fluoride sources are hydrofluoric acid and ammonium bifluoride. It appears that fluorosilicic acid does not provide sufficient active fluoride ions to be useful in the processes of this invention. The precise fluoride ion concentration is unimportant so long as it is such that the current density during anodization is maintained within the desired range.

The anodizing solutions should have a pH of less than 6 and preferably less than 3, the reason being that hydrogen ions catalyze or participate in fluoride attack on the oxide coating. At a pH of about 7, essentially non-porous coatings have been obtained.

Exemplary of the oxidizing anions useful in the processes of this invention are dichromate (most preferred), sulfate, nitrate and phosphate. Organic anions such as oxalate, citrate and tartrate can also be used, but are not preferred. When sulphuric, nitric or phosphoric acid is used, a more stable anodizing bath is obtained if chromic acid is included. The concentration of oxidizing anions appears to have no effect on the thickness or character of the coating obtained. Concentrations of $CrO_3$ as low as 2.5% and as high as 10% by weight have been used with good success.

Anodizing is preferably carried out at temperatures of from 50° to 80° F. Higher temperatures e.g., up to 120° F., can be used, but the coatings are thinner and process control is more difficult. Good results can be obtained at lower temperatures (e.g., even down to 32° F.), but operation at such low temperatures is not commercially attractive.

Current densities should be maintained at from about 0.25 to about 5 asf., preferably at from about 0.5 to about 4 asf., more preferably at from about 1 to 3 asf., and most preferably at about 2 asf. Fluoride ion concentrations resulting in current densities much lower than 0.5 asf. may be too low to assure formation of uniform, porous, oxide coatings while fluoride ion concentrations resulting in current densities much higher than 4 may result in an oxide dissolution rate that is too high to allow a porous coating to be formed. Agitation of the anodizing solution is necessary for maintenance of uniform current density. However, very little agitation is necessary to create stable anodizing conditions. The current density is easily controlled in the process of this invention when the anodizing potential is maintained within the range of from about 5 to about 40 volts. Potential variations within this range have little if any effect on current density. As the potential is increased above 40 volts, a point is reached (usually within the range of from 50 to 90 volts and decreasing with increasing temperature) where pitting of the oxide begins to occur and the current density begins to increase rapidly. Because of the superior adhesive bonding obtained using titanium adherends anodized at potentials of from about 7.5 to about 20 volts, this range is preferred. From about 10 to about 15 volts is especially preferred.

Part orientation in relation to the cathodes and to each other does not appear to be of significance as long as they do not touch each other or the cathode. Test panels have been anodized together and quite often were only a fraction of an inch apart, but the appearance and bondability of the surfaces facing each other were no different from the sides facing the cathodes.

It is presently most preferred to anodize at about 10 volts potential in a mildly agitated, room temperature solution of 5% chromic acid activated with fluoride ions derived from hydrofluoric acid or ammonium bifluoride at concentrations such as to maintain the current density at $2 \pm 1$ asf. A hot alkaline etch in lieu of the standard nitric acid-hydrofluoric acid pickle is the best preanodization treatment studied. The alkaline etch is capable of adequately removing the scale formed on Ti-6Al-4V during thermal forming processes provided the scale is thoroughly conditioned first.

The process of this invention is applicable both to pure titanium and to titanium-based alloys, e.g., those containing alloying constituents such as aluminum, vanadium, molybdenum, iron, manganese, tin, chromium and zirconium. In addition to being useful for producing coatings on titanium, the processes of this invention are potentially useful for producing adhesion-promoting coatings on other metals that exhibit active-passive states, e.g., iron, molybdenum, nickel, chromium, cobalt, tungsten, tantalum, beryllium, aluminum, magnesium, and alloys thereof. The optimum anodizing voltages and current densities for these metals will be lower than those for titanium.

Titanium panels used in the following examples were 0.050-inch thick Ti-6Al-4V alloy, mill annealed. Two liquid adhesives were employed as primers: "EA 9202" (available from Hysol Division of Dexter Corporation) and "BR 127" (available from American Cyanamid). Two adhesive films were also used: Hysol "EA 9628," 0.045 lbs./ft.$^2$ (7 mil) and 0.060 lbs./ft.$^2$ (10 mil). All adhesives were modified epoxys.

Anodizing Procedures

The desired anodization current densities were established by (a) immersing a titanium panel into the anodizing solution and connecting it and a cathode (C.P. titanium) to the positive and negative leads of a rectifier, (b) while agitating the solution, slowly increasing the potential (at 10V/min.) until the desired voltage was reached and (c) when the current had come to equilibrium and while maintaining agitation and the desired voltage, slowly adding a fluoride source until the current reached the desired current density. Once the desired density had been established, anodizing of test panels was carried out by (a) immersing panels in the anodizing solution and making electrical connections, (b) slowly applying voltage so that the desired value was obtained in ½ to 1 minute, (c) readjusting the voltage until the current had stabilized and anodizing for the remainder of the time desired, (d) terminating anodizing, disconnecting panels and cold water immersion rinsing for 5 to 10 seconds, then cold water spray rinsing for 5 minutes, and (e) hot air drying at 140°–160° F. for at least 30 minutes. Anodizing time was measured from power-on to power-off in all experiments.

Assembly Preparation

To fabricate a bonded assembly, two identically processed panels were sprayed with a primer adhesive (0.1–0.4 mils) and baked at 250° F. for 1 hour. To complete the adhesive system, a 6-inch square of EA 9628 adhesive film (either 7 to 10 mils thick) was then placed between the two panels with the primed sides against the adhesive, a ½-inch strip of separator film having been placed along one edge of the primed surface of one of the panels. The assemblies were then cured in an autoclave at 250° F. and 50 psi pressure for 90 minutes.

Specimen Preparation

The bonded assemblies were sheared into five 1-inch × 6-inch strips, the direction of shearing being perpendicular to the separator strip. In most instances, four of these strips were used for wedge testing and the remaining strip was machined into lap shear specimens. Wedge test specimens were prepared by opening the separator end of the 1-inch by 6-inch strip and forcing a 0.125 inch thick wedge between the adherends, taking care that the wedge maintained a sustained stress on the crack tip.

Lap shear specimens were prepared by carefully machining a ½ inch overlap into the center of a 1-inch by 6-inch strip. After lap shear testing, the remaining halves were again machined into ½ inch overlaps specimens, these shorter lap shear specimens being used for sustained load testing.

Wedge Testing

The wedge specimens were exposed to two environments for evaluation of the stability of the bonded system. Twenty-four hours exposure to boiling water was the primary test environment and 4 days exposure to 140° F./100% relative humidity was used as a spot check. Before exposing the wedge specimens to the environments, the initial crack length, $a_o$, was measured. Upon exposure to the environments, crack growth, $\Delta a$, was measured after 24 hours for the water boil test, and 4 days for the 140° F./100% relative humidity tests. At the termination of these tests, all specimens were torn apart and the failure modes carefully examined, with particular attention being directed to the area along which cracking had occurred. The presence or lack of failure at the primer-oxide interface (adhesive failure) was a primary consideration for judging a surface treatment. The just-described wedge test simulates a critical tension component of the stress to which titanium composites are typically exposed in aircraft structures.

EXAMPLE I

Four anodizing solutions were prepared using a five-molar solution of ammonium bifluoride for establishing and controlling current density: (a) $HNO_3$ (100g/l) + $CrO_3$ (50g/l) + $NH_4F_2$; (b) $H_2SO_4$ (100g/l) + $CrO_3$ (50g/l) + $NH_4F_2$; (c) $CrO_3$ (50g/l) + $NH_4F_2$; and (d) $H_2SO_4$ (50g/l) + $NH_4F_2$. All panels were precleaned as follows: solvent clean; alkaline clean; spray rinse; pickle ($HNO_3$—HF); and spray rinse.

Two pairs of panels were processed for each condition indicated. Anodization was conducted using the process conditions shown in Table I starting at the lowest current density condition for each of the four solutions. All panels were primed with EA 9202 primer and bonded with EA 9628 adhesive (10 mil).

Referring to Table I, all assemblies produced from panels anodized in solutions a–d exhibited less crack extension than did the controls. The failure mode in the controls was 100% adhesive. Of the four anodizing solutions, that containing 5% $CrO_3$ resulted in the least adhesive mode failure (5–40%), and thus, the best environmental stability.

Four days exposure to 140° F./100% relative humidity did not result in any significant extension of the crack tip for any of the assemblies of this invention. The phosphate-fluoride controls showed considerably more crack extension in comparison (0.71 inch average versus 0.05–0.15 inch average).

EXAMPLE II

Two procedures frequently used to thermal form Ti-6Al-4V are drape forming and creep forming. Both methods expose the titanium to 1425+° F., which in the presence of air, forms a thick, tenacious, oxide scale on the surface. One procedure for removal of this scale involves conditioning (or softening) the scale in a hot alkaline conditioner, rinsing with water and then immersing in a nitric-hydrofluoric acid pickle solution for 1–3 minutes. However, as indicated previously, tests have shown that a nitric-hydrofluoric acid pickle can cause a subsequent embrittlement at the oxide-metal interface. This embrittlement can be minimized by using a hot alkaline etch in lieu of the acid pickle.

The following procedure was used to simulate typical production conditions, including two thermal forming procedures. Ti-6Al-4V test panels were treated as follows: (a) solvent wipe; (b) alkaline clean in Kelite 235 (Kelite Corp., Los Angeles, Calif.) for 10 minutes; (c) immerse in nitric acid solution for 20 minutes, cold water rinse, then hot water rinse; (d) spray with a heat-protective coating to a dry-film thickness of 0.4–1.0 mils; and (e) air dry 1 hour. The panels were then subjected to one of the following thermal forming conditions: (1) Drape form — (a) heat to 1425° F. at 12° F./min.; (b) hold for 10 min., and (c) cool at 130° F./min. or faster. The panels were then subjected to the precleaning conditions and anodizing conditions shown in Table II. The scale conditioner employed was Brant 8224 conditioner. The solution used for alkaline etching was Kelite 235.

After being anodized or coated by the phosphate-fluoride process (controls), all test panels were primed with BR 127 primer and then bonded with 7 mil EA 9628 adhesive. The test results are shown in Table II. The wedge tests showed the excellent environmental stability of the bonded systems of this invention; the lap shear strengths were also excellent. In tearing apart wedge specimens there was no evidence of oxide-metal failure on any specimens with the exception of the controls and No. 7 which had been acid etched prior to anodizing. Lap shear failure modes still indicated some oxide-metal interfacial failure with the exception of conditions 1 and 4. These two conditions gave optimum results in that all failures occurred 100% within the adhesive (100% cohesive failure), and also showed the highest lap shear strengths. The results indicate that the use of the acid pickle followed by alkaline etching in the descaling process induces a slight degree of embrittlement at the oxide-metal surface. Other experiments have indicated that dipping of panels into nitric acid for 5 minutes after alkaline etching does not have any significant influence on the oxide-metal interface when comparing the lap shear failure modes or the wedge test specimens.

The specimen halves remaining after lap shear testing of specimens 1, 4 and 10 (see Table II), were machined into ½ inch overlap specimens (one from each half). The resulting six specimens were then placed in 140° F./100% relative humidity chamber and subjected to a dead weight load of 1,000 lb. (2000 psi). The time to failure for each specimen was recorded by a timer and is reported in Table III together with the observed failure mode. The average time to failure for the four assemblies of this invention was 17.45 hours while that for the controls was only 0.25 hours.

Unless otherwise indicated, the term "titanium" as used herein and in the appended claims refers both to pure titanium and to titanium-based alloys.

TABLE I

| | | ANODIZING** | WEDGE TEST*** | | |
|---|---|---|---|---|---|
| | SOLUTION | CURRENT | WATER BOIL | | 140°F/100% RH |
| | + ($NH_4HF_2$) | DENSITY (ASF) | 24 HOURS Δa* (Inch) | FAIL MODE (% Adhesive) | 4 DAYS Δa* (Inch) |
| (a) | $CrO_3$ (5%) | 1.0 | 1.04 | 40% | .11 |
| | | 1.5 | .96 | 8% | .10 |
| | | 2.0 | 1.03 | 10% | .09 |
| | | 2.5 | .88 | 5% | .08 |
| (b) | $H_2SO_4$(10%)-$CrO_3$(5%) | 1.0 | 1.06 | 30% | .15 |
| | | 1.5 | 1.12 | 75% | .07 |
| | | 2.0 | 1.06 | 70% | .11 |
| | | 2.5 | 1.05 | 90% | .11 |
| | | 3.0 | 1.13 | 80% | .09 |
| (c) | $HNO_3$(10%)-$CrO_3$ (5%) | 1.0 | 1.10 | 100% | .05 |
| (d) | $H_2SO_4$ (5%) | 1.0 | 1.00 | 70% | .08 |
| | | 1.5 | .87 | — | .09 |
| | Control (Phosphate-Fluoride) | | 1.69 | 100% | .71 |

*Crack extension.
**For 20 min; Potential = 10V.
***Average of two specimens for each condition.

TABLE II

| PRECLEANING | THERMAL FORMING PROCESS | NO. | ANODIZING* (VOLTS) | WEDGE TEST WATER BOIL 24 HOUR Δa (Inch) | WEDGE TEST WATER BOIL FAIL MODE (% Adhesive) | LAP SHEAR TEST psi** | LAP SHEAR TEST FAIL MODE (% Adhesive) |
|---|---|---|---|---|---|---|---|
| 5% CHROMIC ACID + HF, 20 MINUTE ANODIZE at 2 ASF | | | | | | | |
| Condition 10 min + hot rinse; alkaline etch 10 min + hot rinse | DRAPE | 1 | 10 | .98 | 0% | 6020 | 0% |
| | CREEP | 4 | 10 | .99 | 0% | 5960 | 0% |
| Condition 30 min + hot rinse; $HNO_3$—HF pickle 3 min + cold rinse; etch 20 min + hot rinse | DRAPE | 2 | 10 | .90 | 0% | 5640 | 90% |
| | | 3 | 15 | .88 | 0% | 5200 | 95% |
| | CREEP | 5 | 10 | .92 | 0% | 5680 | 80% |
| | | 6 | 15 | .95 | 0% | 5460 | 95% |
| Etch 5 min + hot rinse; $HNO_3$—HF pickle 3 min + cold rinse; etch 10 min + hot rinse | | 7*** | 10 | .94 | 0% | 5080 | 100% |
| | | 7A | 10 | — | 0% | 5700 | 95% |
| | NONE | 8 | 15 | .93 | 0% | 5680 | 85% |
| Etch 5 min + hot rinse; etch 10 min + hot rinse | NONE | 9 | 10 | — | 0% | 5640 | 70% |
| CONTROLS Phosphate-Fluoride | | 10 | | 1.42 | 100% | 5740 | 10% |

*For 20 min. in 5% Chromic Acid + HF at 2 asf.
**At room temperature.
***Second alkaline etch omitted in precleaning process.

TABLE III

| Titanium Pretreatment | Sustained Stress Shear Test* Specimen No. (See Table II) | Time to Failure (Hours) | Failure Mode (% Adhesive) |
|---|---|---|---|
| Anodized in 5% $CrO_3$ + HF for 20 min. at 10V + 2 asf. | 1 | 17.3 | 40% |
| | 1′ | 19.7 | 35% |
| Anodized in 5% $CrO_3$ + HF for 20 min. at 10V + 2 asf. | 4 | 17.0 | 20% |
| | 4′ | 15.8 | 45% |
| Controls (Phosphate-Fluoride) | 10 | 0.2 | 80% |
| | 10′ | 0.3 | 80% |

*2000 psi. stress in 140° f./100% relative humidity

What is claimed is:

1. An adhesively bonded composite article comprising first and second adherends, said first adherend including a titanium element having an oxide layer on the surface thereof; and an adhesive system bonded to said oxide layer and to said second adherend, said oxide layer having been produced by anodizing said surface of said titanium element in an aqueous solution comprising fluoride ions and an oxidizing electrolyte, the pH of said solution being less than 6, the anodizing potential being from about 5 to about 40 volts, and the fluoride ion concentration being such as to result in a current density of from about 0.25 to about 5 amperes per square foot.

2. A composite of claim 1 wherein said current density is from about 0.5 to about 4 amperes per square foot.

3. A composite of claim 1 wherein the anodizing potential employed is from about 7.5 to about 20 volts.

4. A composite of claim 3 wherein said current density is from about 1 to about 3 amperes per square foot.

5. A composite of claim 1 wherein the anodizing potential employed is from about 10 to about 15 volts.

6. A composite of claim 5 wherein said current density is from about 1 to about 3 amperes per square foot.

7. The article of claim 1 wherein said oxidizing electrolyte comprises ions selected from the group consisting of dichromate, sulfate, phosphate, nitrate and mixtures thereof.

8. The article of claim 7 wherein the source of fluoride ion is selected from the group consisting of hydrogen fluoride, sodium fluoride, potassium fluoride, ammonium fluoride, ammonium bifluoride and mixtures thereof.

9. The article of claim 1 wherein said oxidizing electrolyte comprises dichromate ions.

10. The article of claim 9 wherein the source of fluoride ion is selected from the group consisting of hydrogen fluoride, sodium fluoride, potassium fluoride, ammonium fluoride, ammonium bifluoride and mixtures thereof.

11. The article of claim 1 wherein the source of fluoride ion is selected from the group consisting of hydrogen fluoride, sodium fluoride, potassium fluoride, ammonium fluoride, ammonium bifluoride and mixtures thereof.

12. The article of claim 1 wherein the temperature of said solution is from about 50° F. to about 80° F.

13. The article of claim 6 wherein said oxidizing electrolyte comprises ions selected from the group consisting of dichromate, sulfate, phosphate, nitrate and mixtures thereof.

14. The article of claim 13 wherein the source of fluoride ion is selected from the group consisting of hydrogen fluoride, sodium fluoride, potassium fluoride, ammomium fluoride, ammonium bifluoride and mixtures thereof.

15. The article of claim 6 wherein said oxidizing electrolyte comprises dichromate ions.

16. The article of claim 15 wherein the source of fluoride ion is selected from the group consisting of hydrogen fluoride, sodium fluoride, potassium fluoride, ammonium fluoride, ammonium bifluoride and mixtures thereof.

17. The article of claim 1 wherein the pH of said solution is less than 3.

18. In a process for manufacturing an adhesively bonded titanium structure the improvement wherein the titanium elements to be bonded together are anodized in an aqueous solution comprising fluoride ions and an oxidizing electrolyte, the pH of said solution being less than 6, the anodizing potential being from about 5 to about 40 volts, and the fluoride concentration being such as to result in a current density of from about 0.25 to 5 amperes per square foot, whereby a porous, adhesion-promoting oxide coating is formed on said elements.

19. The process of claim 18 wherein said oxidizing electrolyte comprises ions selected from the group consisting of dichromate, sulfate, phosphate, nitrate and mixtures thereof.

20. The process of claim 19 wherein the source of fluoride ion is selected from the group consisting of hydrogen fluoride, sodium fluoride, potassium fluoride, ammonium fluoride, ammonium bifluoride and mixtures thereof.

21. The process of claim 18 wherein said oxidizing electrolyte comprises dichromate ions.

22. The process of claim 21 wherein the source of fluoride ion is selected from the group consisting of hydrogen fluoride, sodium fluoride, potassium fluoride, ammonium fluoride, ammonium bifluoride and mixtures thereof.

23. The process of claim 18 wherein the source of fluoride ion is selected from the group consisting of hydrogen fluoride, sodium fluoride, potassium fluoride, ammonium fluoride, ammonium bifluoride and mixtures thereof.

24. The process of claim 18 wherein the temperature of said solution is from about 50° F. to about 80° F.

25. The process of claim 18 wherein said current density is maintained at from about 1 to about 3 amperes per square foot.

26. The process of claim 25 wherein said potential is from about 10 to about 15 volts.

27. The process of claim 26 wherein said oxidizing electrolyte comprises ions selected from the group consisting of dichromate, sulfate, phosphate, nitrate and mixtures thereof.

28. The process of claim 27 wherein the source of fluoride ion is selected from the group consisting of hydrogen fluoride, sodium fluoride, potassium fluoride, ammonium fluoride, ammonium bifluoride and mixtures thereof.

29. The process of claim 26 wherein said oxidizing electrolyte comprises dichromate ions.

30. The process of claim 29 wherein the source of fluoride ion is selected from the group consisting of hydrogen fluoride, sodium fluoride, potassium fluoride, ammonium fluoride, ammonium bifluoride and mixtures thereof.

31. The process of claim 18 wherein the pH of said solution is less than 3.

32. The process of claim 18 wherein said anodizing potential is from about 7.5 to about 20 volts.

33. The process of claim 18 wherein said anodizing potential is from about 10 to about 15 volts.

* * * * *